US007251601B2

(12) United States Patent
Kagoshima et al.

(10) Patent No.: US 7,251,601 B2
(45) Date of Patent: Jul. 31, 2007

(54) SPEECH SYNTHESIS METHOD AND SPEECH SYNTHESIZER

(75) Inventors: Takehiko Kagoshima, Kawasaki (JP); Masami Akamine, Yokosuka (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 763 days.

(21) Appl. No.: 10/101,689

(22) Filed: Mar. 21, 2002

(65) Prior Publication Data

US 2002/0138253 A1 Sep. 26, 2002

(30) Foreign Application Priority Data

Mar. 26, 2001 (JP) ..... 2001-087041

(51) Int. Cl.
*G10L 13/04* (2006.01)

(52) U.S. Cl. ..... 704/268

(58) Field of Classification Search ..... None
See application file for complete search history.

(56) References Cited

U.S. PATENT DOCUMENTS 4,051,331 A * 9/1977 Strong et al. ..... 381/320
4,542,524 A * 9/1985 Laine ..... 704/269
4,692,941 A * 9/1987 Jacks et al. ..... 704/260
5,274,711 A * 12/1993 Rutledge et al. ..... 704/225
5,864,812 A * 1/1999 Kamai et al. ..... 704/268
5,890,118 A 3/1999 Kagoshima et al.
6,240,384 B1 5/2001 Kagoshima et al.
6,708,154 B2 * 3/2004 Acero ..... 704/260

FOREIGN PATENT DOCUMENTS

JP 10-240264 9/1998

OTHER PUBLICATIONS

Masato Kawamata, et al., "Classification and Evalution of Nonlinear Parameter Patterns Due to Vocal Folds Vibration", Proceedings 2001 Spring Meeting of the Acoustical Society of Japan, 2-6-7, Mar. 2001, pp. 295-296.
J. Wouters, et al., IEEE Transactions on Speech and Audio Processing, vol. 9, No. 1, pp. 30-38, XP-002243376, "Control of Spectral Dynamics in Concatenative Speech Synthesis", Jan. 2001.
X. Rodet, Computer Music Journal, vol. 8, pp. 9-14, XP-008018015, "Time-Domain Formant-Wave-Function Synthesis", 1984.
D. Chazan, et al., IEEE International Conference on Acoustics, Speech and Signal Processing, vol. 3, pp. 1299-1302, XP-010507585, "Speech Reconstruction from MEL Frequency Cepstral Coefficients and Pitch Frequency", Jun. 5, 2000.

(Continued)

*Primary Examiner*—Abul K. Azad
(74) *Attorney, Agent, or Firm*—Oblon, Spivak, McClelland, Maier & Neustadt, P.C.

(57) ABSTRACT

A speech synthesis method comprises selecting a predetermined formant parameters from formant parameters according to a pitch pattern, phoneme duration, and phoneme symbol string, generating a plurality of sine waves based on formant frequency and formant phase of the formant parameters selected, multiplying the sine waves by windowing functions of the selected formant parameters, respectively, to generate a plurality of formant waveforms, adding the formant waveforms to generate a plurality of pitch waveforms, and superposing the pitch waveforms according to a pitch period to generate a speech signal.

20 Claims, 11 Drawing Sheets

OTHER PUBLICATIONS

Y. Stylianou, IEEE International Conference on Acoustics, Speech and Signal Processing, vol. 2, pp. 957-960, XP-010504883, "On the Implementation of the Harmonic Plus Noise Model for Concatenative Speech Synthesis", Jun. 5, 2000.

* cited by examiner

| Phoneme | Frame number | Formant number | Formant frequency | Formant phase | Windowing function |
|---|---|---|---|---|---|
| /a/ | 1 | 1 | 0.11 | 0.01 | |
| | 1 | 2 | 0.23 | -0.20 | |
| | 1 | 3 | 0.35 | 0.15 | |
| | 2 | 1 | 0.10 | 0.02 | |
| | 2 | 2 | 0.24 | -0.15 | |
| | 2 | 3 | 0.36 | 0.20 | |
| | 3 | 1 | 0.09 | 0.04 | |
| | 3 | 2 | 0.25 | -0.12 | |
| | 3 | 3 | 0.38 | 0.23 | |

FIG. 4

| Phoneme | Frame number | Formant number | Formant frequency | Formant phase | Windowing function weighting factor |
|---|---|---|---|---|---|
| /a/ | 1 | 1 | 0.11 | 0.01 | 5.8, 1.2, -0.4 |
| | 1 | 2 | 0.23 | -0.20 | 6.4, 2.0, 0.1 |
| | 1 | 3 | 0.35 | 0.15 | 7.1, 3.1, 0.3 |
| | 2 | 1 | 0.10 | 0.02 | 7.8, 3.7, 0.4 |
| | 2 | 2 | 0.24 | -0.15 | 8.2, 3.7, 0.2 |
| | 2 | 3 | 0.36 | 0.20 | 8.3, 3.6, -0.1 |
| | 3 | 1 | 0.09 | 0.04 | 8.0, 3.2, -0.3 |
| | 3 | 2 | 0.25 | -0.12 | 7.5, 2.8, -0.5 |
| | 3 | 3 | 0.38 | 0.23 | 6.9, 2.2, -0.6 |

FIG. 5

SPEECH SYNTHESIS METHOD AND SPEECH SYNTHESIZER

CROSS-REFERENCE TO RELATED APPLICATIONS

This application is based upon and claims the benefit of priority from the prior Japanese Patent Application No. 2001-087041, filed Mar. 26, 2001, the entire contents of which are incorporated herein by reference.

BACKGROUND OF THE INVENTION

1. Field of the Invention

The present invention relates to a text-to-speech synthesis, particularly a speech synthesis method of generating a synthesized speech from information such as phoneme symbol string, pitch, and phoneme duration.

2. Description of the Related Art

"Text-to-speech synthesis" means producing artificial speech from text. This text-to-speech synthesis system comprises three stages: a linguistic processor, prosody processor and speech signal generator.

At first, the input text is subjected to morphological analysis or syntax analysis in a linguistic processor, and then the process of accent and intonation is performed in the prosody processor, and information such as phoneme symbol string, pitch pattern (the change pattern of voice pitch), and the phoneme duration is output. A speech signal generator, that is, speech synthesizer synthesizes a speech signal from information such as phoneme symbol strings, pitch patterns and phoneme duration.

According to the operational principle of a speech synthesis apparatus for speech-synthesizing a given phoneme symbol string, basic characteristic parameters units (hereinafter referred to as "synthesis units") such as phone, syllable, diphone and triphone are stored in a storage and selectively read out. The read-out synthesis units are connected, with their pitches and phoneme durations being controlled, whereby a speech synthesis is performed.

As a method for generating a speech signal of a desired pitch pattern and phoneme duration from information of synthesis units, the PSOLA (Pitch-Synchronous Overlap-add) method is known. It is known that synthesized speech based on PSOLA reduces speech quality degradation due to pitch period variation, and improves speech quality, when the pitch period variation is small. However, PSOLA has a problem in that speech quality deteriorates when the pitch period variation is large. Further, there is a problem that distortion occurs in the spectrum due to the smoothing process performed when a discontinuous spectrum occurs when synthesis units are combined, resulting in deterioration in the speech quality. Furthermore, PSOLA makes change of voice variety difficult and lack flexibility since the waveform itself is used as a synthesis unit.

An alternative method involves a formant synthesis. This system was designed to emulate the way humans speak. The formant synthesis system generates a speech signal by exciting a filter modeling the property of vocal tract with a speech source signal obtained by modeling a signal generated from the vocal cords.

In this system, the phonemes (/a/, /i/, /u/, etc) and voice variety (male voice, female voice, etc.) of synthesized speech are determined by combining the formant frequency with the bandwidth. Therefore, the synthesis unit information is generated by combining the formant frequency with the bandwidth, rather than the waveform. Since the formant synthesis system can control parameters relating to phoneme and voice variety, it is advantageous in that variations in the voice variety and so on can be flexibly controlled. However, the precision of modeling lacks, which is disadvantageous.

In other words, the formant synthesis system cannot mimic the finely detailed spectrum of real speech signal because only the formant frequency and bandwidth are used, meaning that speech quality is unacceptable.

It is an object of the present invention to provide a speech synthesizer, which improves a speech quality and can flexibly control voice variety.

BRIEF SUMMARY OF THE INVENTION

According to the first aspect of the invention, there is provided a speech synthesis method comprising: preparing a number of formant parameters, selecting a predetermined formant parameters from formant parameters according to a pitch pattern, phoneme duration, phoneme symbol string; generating a plurality of sine waves based on formant frequency and formant phase of the formant parameters selected; multiplying the sine waves by windowing functions of the selected formant parameters, respectively, to generate a plurality of formant waveforms; adding the formant waveforms to generate a plurality of pitch waveforms; and superposing the pitch waveforms according to a pitch period to generate speech signals.

According to the second aspect of the invention, there is provided a speech synthesizer comprising: a pitch mark generator configured to generate pitch marks referring to the pitch pattern and phoneme duration; a pitch waveform generator configured to generate pitch waveforms to the pitch marks, referring to the pitch pattern, phoneme duration and phoneme symbol string; a waveform superposition device configured to superposes the pitch waveforms on the pitch marks to generate a voiced speech signal; an unvoiced speech generator configured to generate an unvoiced speech; and an adder configured to add the voiced speech and the unvoiced speech to generate synthesized speech, the pitch waveform generator including a storage configured to store a plurality of formant parameters in units of a synthesis unit, a parameter selector configured to select the formant parameters for one frame corresponding to the pitch marks from the storage referring to the pitch pattern, the phoneme duration and the phoneme symbol string, a sine wave generator configured to generate sine waves according to formant frequencies and formant phases of the read formant parameters, a multiplier configured to multiply the sine waves by windowing functions of the selected formant parameters to generate formant waveforms, an adder configured to add the formant waveforms to generate the pitch waveforms.

BRIEF DESCRIPTION OF THE SEVERAL VIEWS OF THE DRAWING

FIG. 4 shows an example of formant parameters;

FIG. 5 shows another example of formant parameters;

DETAILED DESCRIPTION OF THE INVENTION

There will now be described embodiments of the present invention in conjunction with accompanying drawings.

Figure 1:
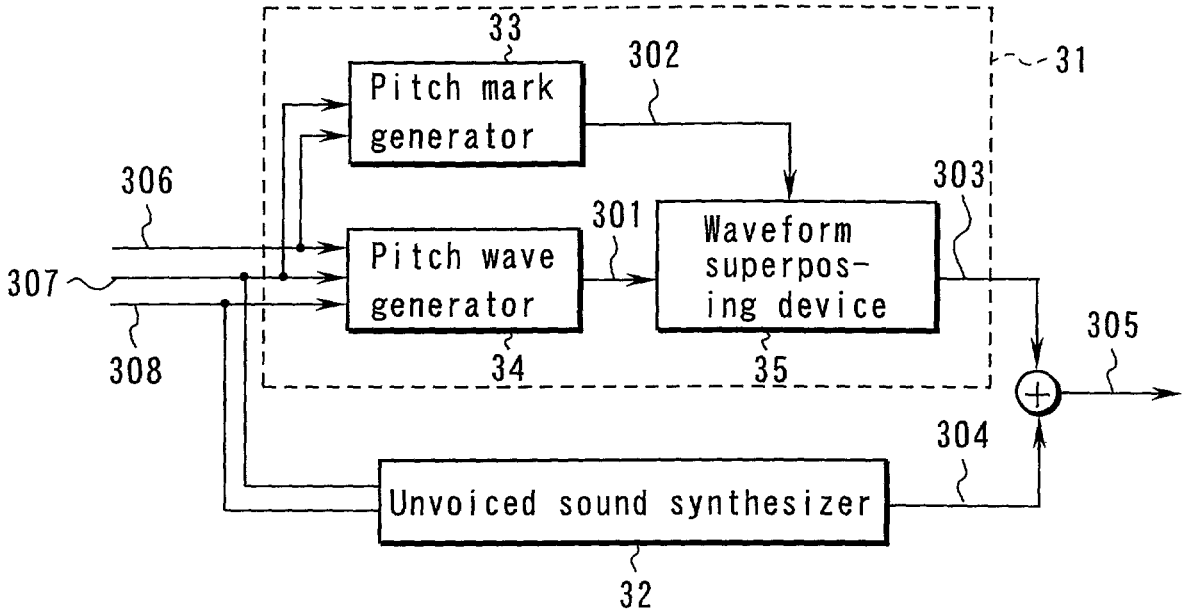
FIG. 1 shows a block diagram of a speech synthesizer of an embodiment of the present invention.

FIG. 1 shows a configuration of a speech synthesizer realizing a speech synthesis method according to the first embodiment of the present invention. The speech synthesizer receives pitch pattern 306, phoneme duration 307 and phoneme symbol string 308 and outputs a synthesized speech signal 305. The speech synthesizer comprises a voiced speech synthesizer 31 and an unvoiced sound synthesizer 32, and generates the synthesized speech signal 305 by adding the unvoiced speech signal 304 and voiced speech signal 303 output from the synthesizers, respectively.

The unvoiced speech synthesizer 32 generates the unvoiced speech signal 304 referring to phoneme duration 307 and phoneme symbol string 308, when the phoneme is mainly an unvoiced consonant and voiced fricative sound, The unvoiced speech synthesizer 32 can be realized by a conventional technique, such as the method of exciting an LPC synthesis filter with white noise.

Figure 2:
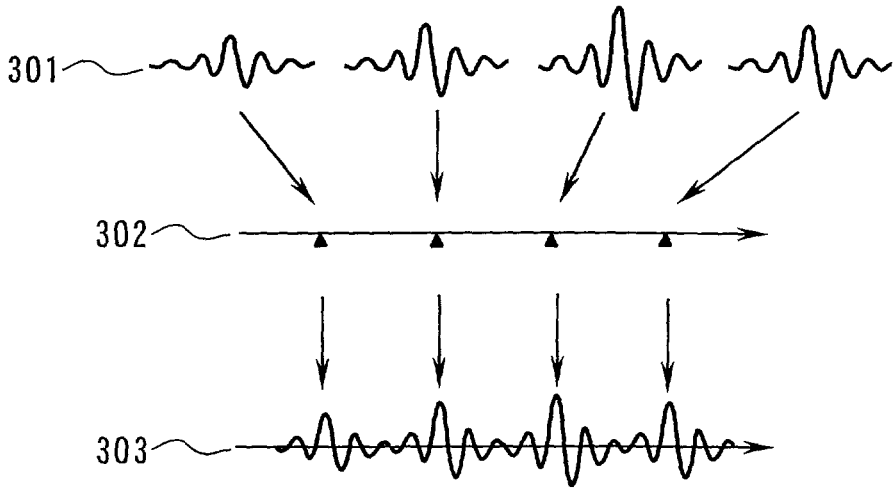
FIG. 2 shows a process of generating voiced speech by superposing pitch waveforms.

The voiced speech synthesizer 31 comprises a pitch mark generator 33, a pitch waveform generator 34 and a waveform superposing device 35. The pitch mark generator 33 generates pitch marks 302 as shown in FIG. 2 referring to the pitch pattern 306 and phoneme duration 307. The pitch marks 302 indicate positions at which the pitch waveforms 301 are superposed. The interval between the pitch marks correspond to the pitch period. The pitch waveform generator 34 generates pitch waveforms 301 corresponding to the pitch marks 302 as shown in FIG. 2, referring to the pitch pattern 306, phoneme duration 307 and phoneme symbol string 308. The waveform superposing device 35 generates a voiced speech signal 303 by superposing, at positions of the pitch marks 302, the pitch waveforms corresponding to the pitch marks 302.

The configuration of the pitch waveform generator of FIG. 1 will be described in detail as follows.

Figure 3:
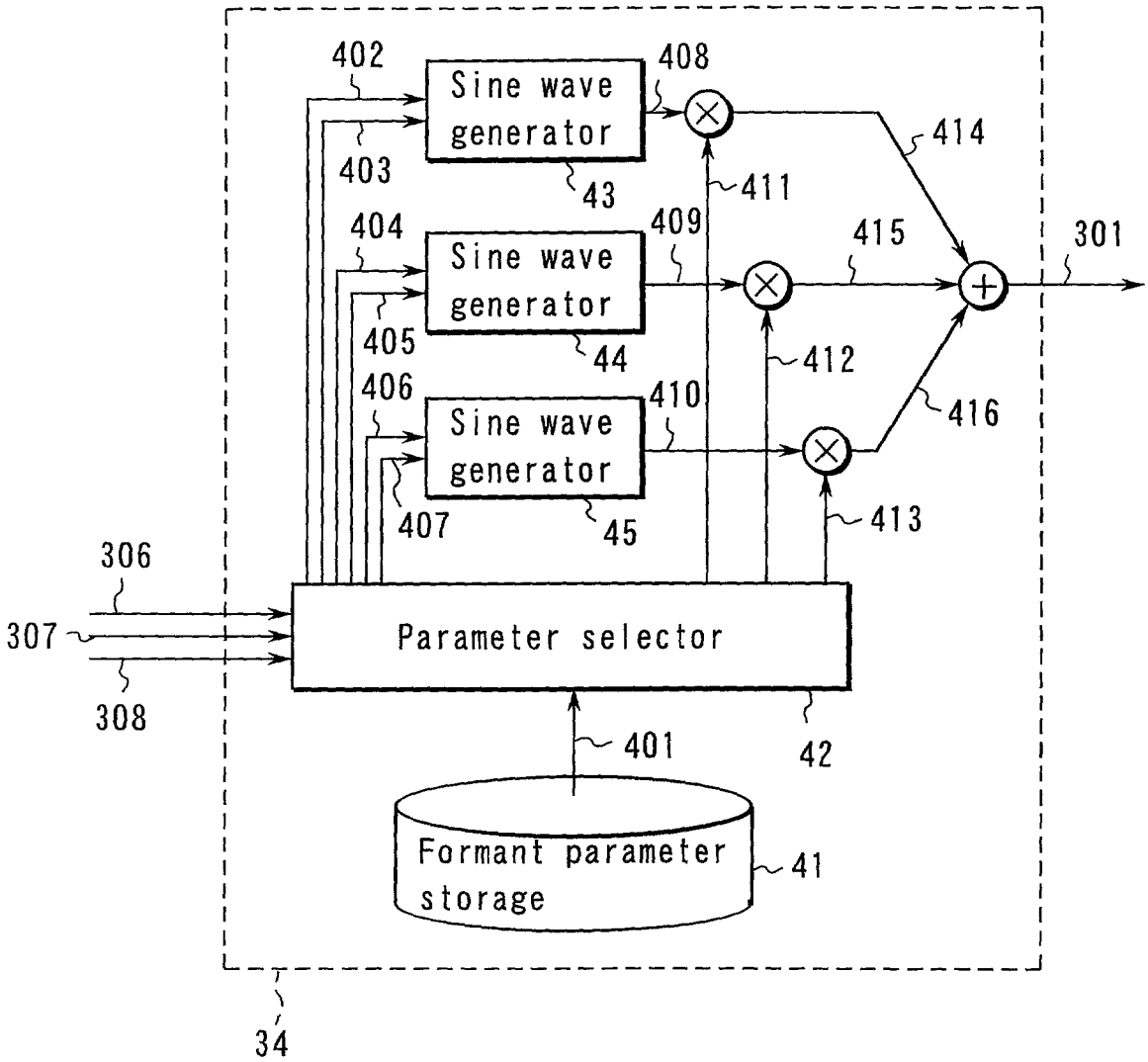
FIG. 3 shows a block diagram of pitch waveform generation club related to the first embodiment of the present invention.

The pitch waveform generator 34 comprises a formant parameter storage 41, a parameter selector 42 and sine wave generators 43, 44 and 45 as shown in FIG. 3. The formant parameters are stored in the formant parameter storage 41 in units of a synthesis unit.

FIG. 4 indicates an example of formant parameters of phonemes /a/. In this example, the phonemes /a/ comprise three frames each including three formants. Formant frequency, formant phase and windowing functions are stored in the formant parameter storage 41 as parameters to express the characteristics of each formant.

The formant parameter selector 42 selects and reads formant parameters 401 for one frame corresponding to the pitch marks 302 from the formant parameter storage 41, referring to the pitch pattern 306, phoneme duration 307 and phoneme symbol string 308 which are input to the pitch waveform generator 34.

The parameters corresponding to the formant number 1 are read out from the formant parameter storage 41 as formant frequency 402, formant phase 403 and windowing functions 411. The parameters corresponding to the formant number 2 are read out from the formant parameter storage 41 as formant frequency 404, formant phase 405 and windowing functions 412. The parameters corresponding to the formant number 3 are read out from the formant parameter storage 41 as formant frequency 406, formant phase 407 and windowing functions 413. The sine wave generator 43 generates sine wave 408 according to the formant frequency 402 and formant phase 403. The sine wave 408 is subjected to the windowing functions 411 to generate a formant waveform 414. The formant waveform y (t) is represented by the following equation.

$$y(t)=w(t)*\sin(\omega t+\phi)$$

where ω is the format frequency, ϕ is the format phase 403, and w(t) is the windowing function 411.

The sine wave generator 44 outputs sine wave 409 based on the formant frequency 404 and formant phase 405. This sine wave 409 is multiplied by the windowing function 412 to generate a formant waveform 415. The sine wave generator 45 outputs a sine wave 410 based on the formant frequency 406 and formant phase 407. This sine wave 410 is multiplied by the windowing functions 413 to generate a formant waveform 416.

Figure 6:
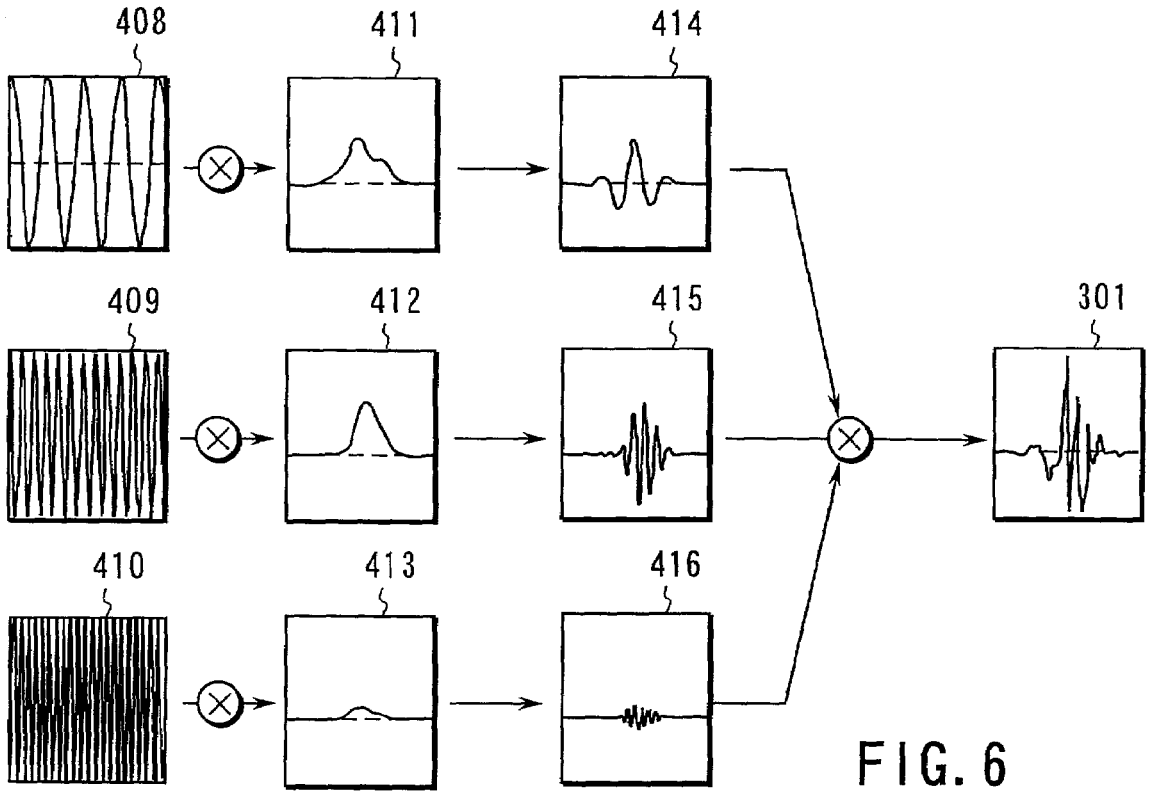
FIG. 6 shows sine waves, windowing functions, formant waveforms and pitch waveforms.
Figure 7:
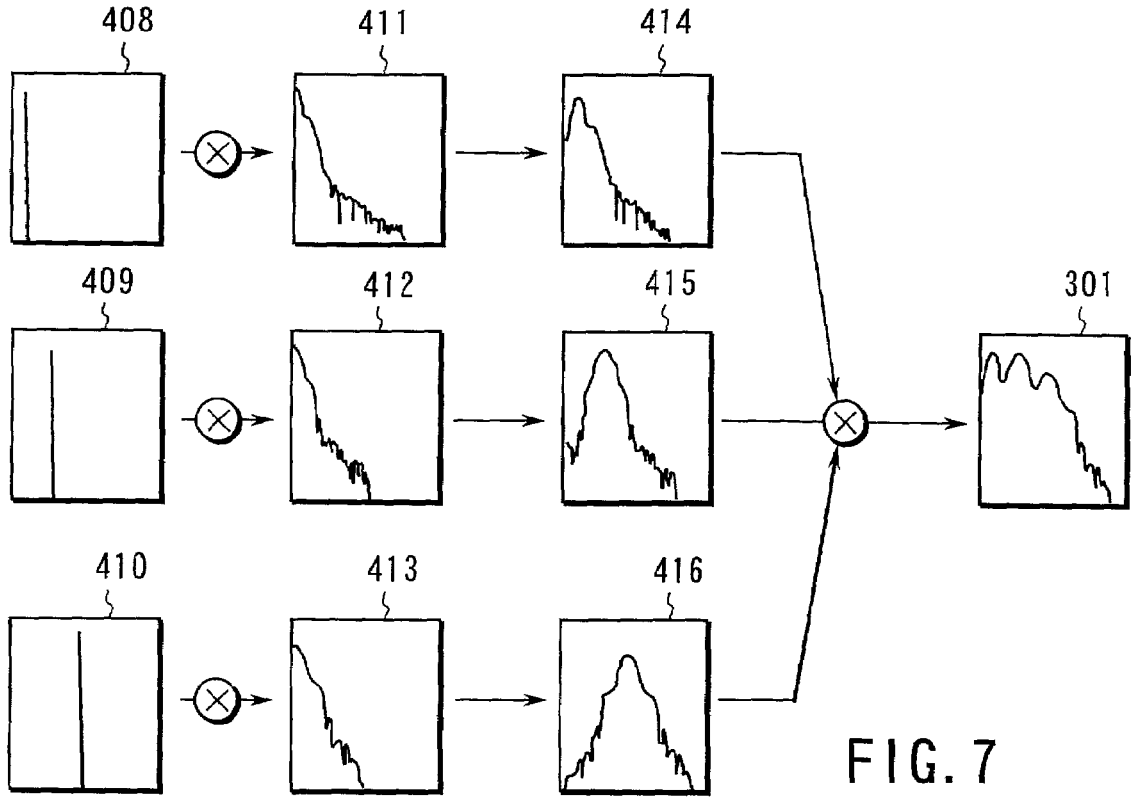
FIG. 7 shows power spectrums of sine waves, windowing functions, formant waveforms and pitch waveform.

Adding the formant waveforms 414, 415 and 416 generates the pitch waveform 301. Examples of the sine waves, windowing functions, formant waveforms and pitch waveforms are shown in FIG. 6. The power spectrums of these waveforms are shown in FIG. 7. In FIG. 6, the abscissa axis expresses time and the ordinate axes express amplitude. In FIG. 7, the abscissa axes express frequency and the ordinate axes express amplitude.

The sine wave becomes a line spectrum having a sharp peak, and the windowing function becomes the spectrum concentrated on a low frequency domain. The windowing (multiplication) in the time domain corresponds to convolution in the frequency domain. For this reason, the spectrum of formant waveform indicates a shape obtained by shifting the spectrum of windowing function to the position of frequency of the sine wave in parallel. Therefore, controlling the frequency or phase of the sine wave can change the center frequency or phase of the formant of the pitch waveform. Controlling the shape of the windowing function can change the spectrum shape of the formant of the pitch waveform.

As thus described, since the center frequency, phase and spectrum shape of the formant can be independently controlled for each formant, a highly flexible model can be realized. Further, since the windowing function allows the highly detailed structure of spectrum to be expressed, the synthesized speech can approximate to a high accuracy the spectrum structure of natural voice, thus producing the feeling of natural voice.

Figure 8:
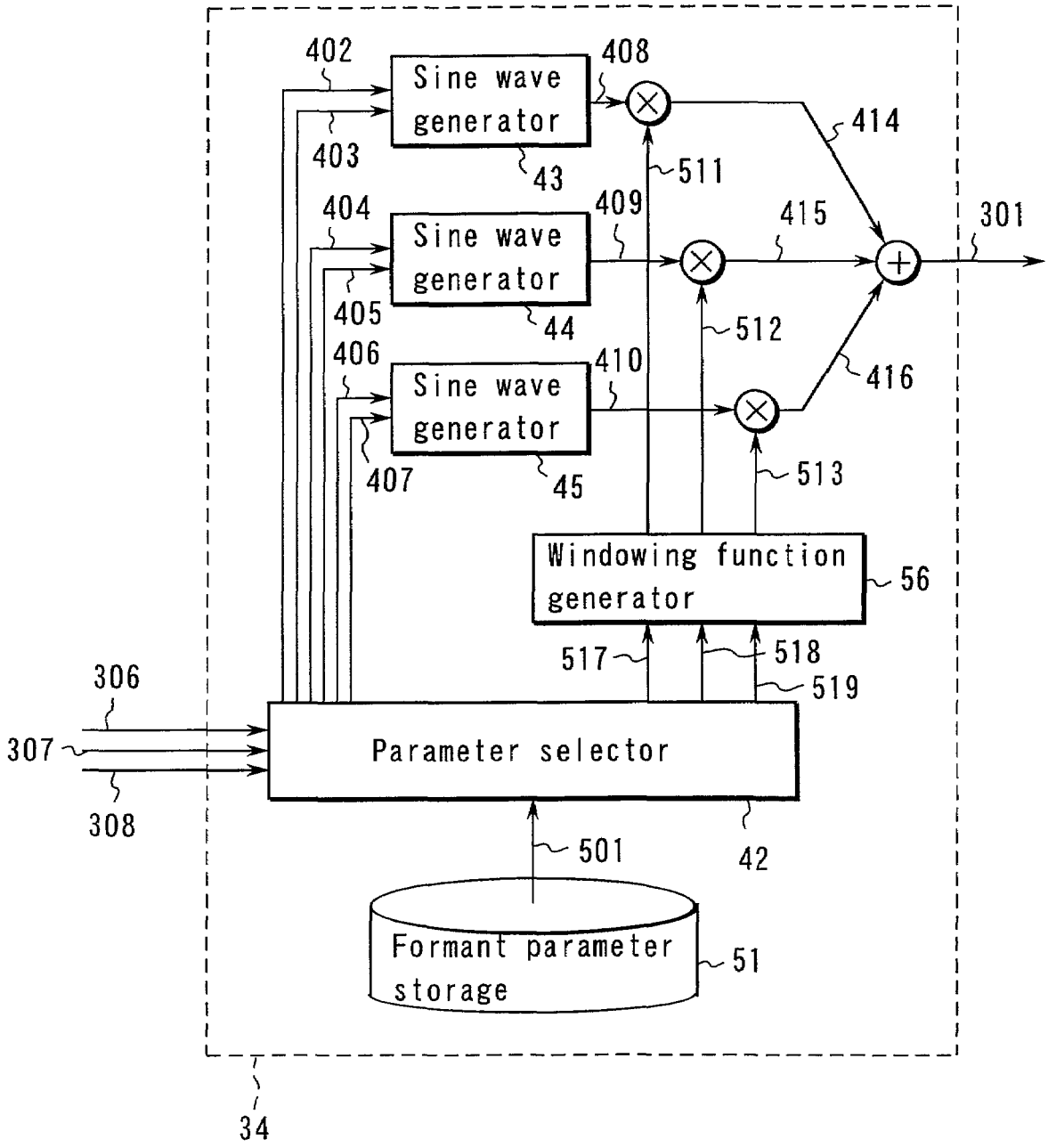
FIG. 8 shows a block diagram of a pitch waveform generator of the second embodiment of the present invention.

The pitch waveform generator 34 of the second embodiment of the present invention will be described referring to FIG. 8. In the second embodiment, like reference numerals are used to designate like structural elements corresponding to those in the first embodiment. Only the portions that differ will be described.

In the present embodiment, the windowing functions are developed by basis functions, and a group of weighting factors is stored in the storage 51 instead of storing the windowing functions as the formant parameters. The windowing function generator 56 newly added generates windowing functions from the weighting factors.

An example of the formant parameters stored in the formant parameter storage 51 is shown in FIG. 5. In the example, the windowing function is obtained by the sum of three basis functions weighted by the weighting factors. A set of three factors is stored in the storage 51 as a set of windowing function weighting factors. The parameter selector 42 outputs the formant frequencies 402, 404 and 406 and formant phases 403, 405 and 407 in the selected formant parameters 501 to the sine wave generators 43, 44 and 45, and outputs a set of windowing function weighting factors 517, 518 and 519 to the windowing function generator 56.

The windowing function generator 56 generates windowing functions 511, 512 and 513 based on the windowing function weighting factors 517, 518 and 519 respectively. If the weighting factors are represented as a1, a2 and a3 and the basis functions as b1 (t), b2 (t) and b3 (t), the window function W(t) is expressed by the following equation.

$$W(t)=a1*b1(t)+a2*b2(t)+a3*b3(t)$$

The basis functions may use DCT basis, and may use basis functions generated by subjecting the windowing functions to KL-expansion. In the present embodiment, the basis order is set to 3, but it is not limited to 3. Developing the windowing functions to the basis functions reduces the memory capacity of the formant parameter storage.

Figure 9:
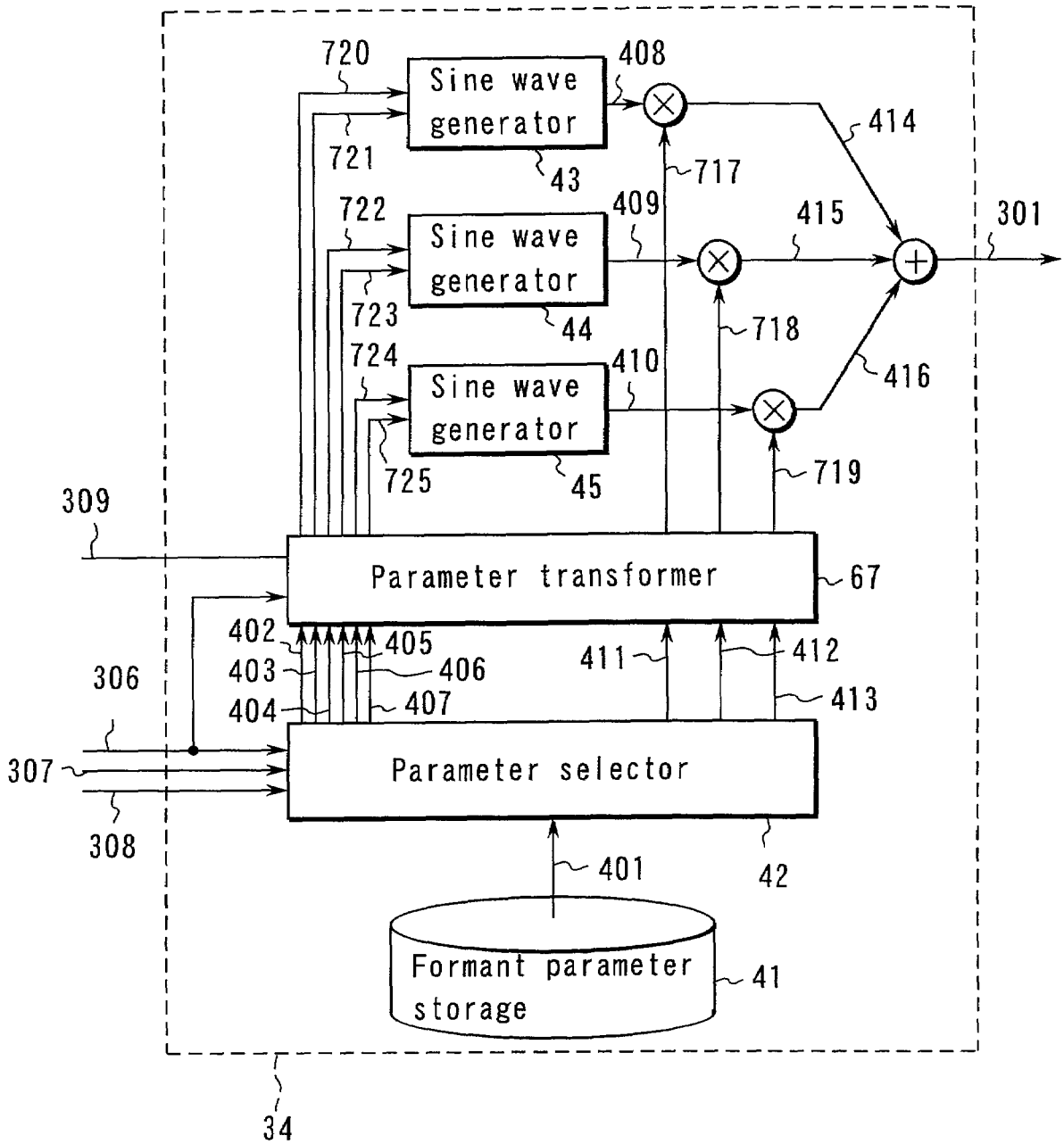
FIG. 9 shows a block diagram of a pitch waveform generator related to the third embodiment of the present invention.

The pitch waveform generator 34 of the third embodiment of the present invention will be described referring to FIG. 9. In the third embodiment, like reference numerals are used to designate like structural elements corresponding to those in the first embodiment. Only the portions that differ will be described. In the present embodiment, a parameter transformer 67 is newly added, and the formant parameters are varied according to the pitch pattern 306.

The parameter transformer 67 outputs formant frequency 720, formant phase 721, windowing function 717, formant frequency 722, formant phase 723, windowing function 718, formant frequency 724, formant phase 725, and windowing function 719 by changing the formant frequency 402, formant phase 403, windowing function 411, formant frequency 404, formant phase 405, windowing function 412, formant frequency 406, formant phase 407, and windowing function 413 according to the pitch pattern 306. All parameters may be changed, and a part of the parameters may be changed.

Figure 10:
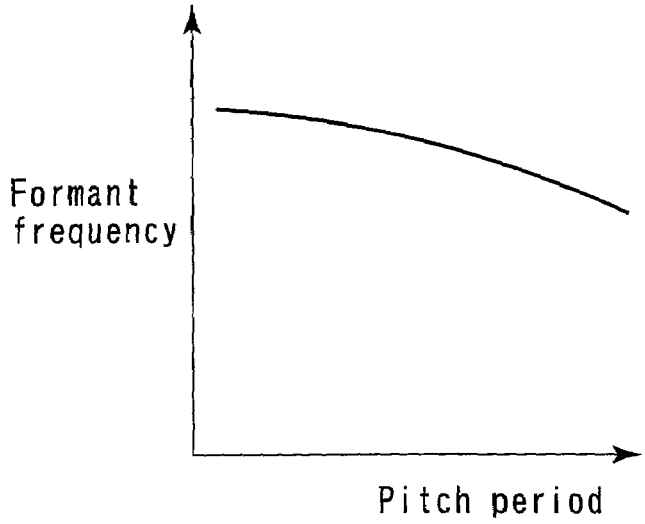
FIG. 10 shows a control function of the formant frequency.

FIG. 10 shows an example of a control function when the parameter transformer 67 controls the formant frequency according to the pitch period. Such control function may be set for every phoneme, every frame or every formant number. The formant frequency can be controlled according to the pitch period, by inputting such control function to the parameter transformer 67. A control function to control the differential value and ratio of the input/output formant frequency may be used instead of the formant frequency itself.

Figure 11:
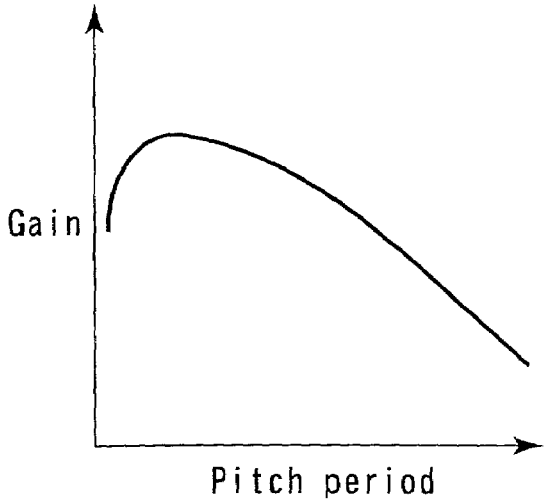
FIG. 11 shows a control function of the formant gain.

FIG. 11 shows the control function to control the power of formant by multiplying the gain corresponding to the pitch period by the windowing functions. It is possible to model the spectrum change of speech according to the change of the pitch period by inputting such a control function to the parameter transformer 67 and changing the parameters according to the pitch period. As a result, it is possible to generate high quality synthesized speech which is not dependent on the pitch of voice.

Further, by inputting phoneme symbol string 308 into parameter transformer 67, the formant parameters may be changed according to a kind of preceding or following phoneme. As a result, it is possible to model a variable speech spectrum based on the phoneme environment, and to improve speech quality.

Furthermore, the voice variety information 309 inputted to the parameter transformer 67 from an external device (not shown) may be altered to produce different parameters. In this case, it is possible to generate synthesized speech of various voice qualities.

Figure 12:
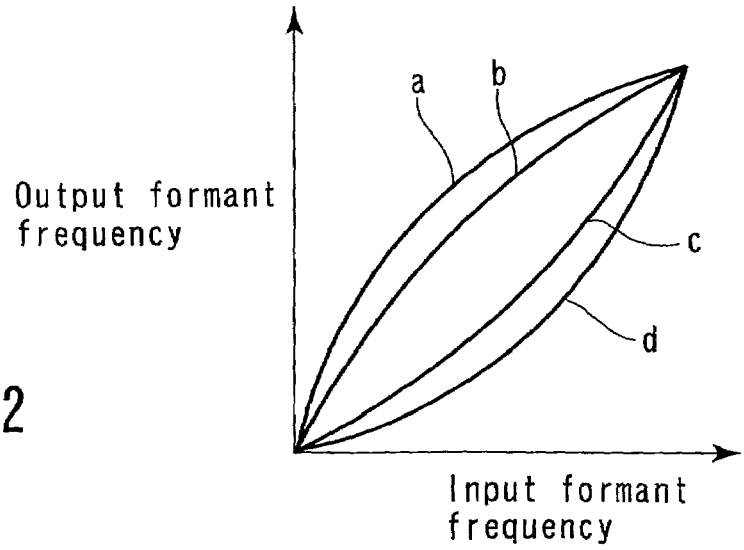
FIG. 12 shows a mapping function of the formant frequency for use in voice variety conversion.

FIG. 12 shows an example of changing the voice pitch by changing the formant frequency. If all formant frequencies are converted by the control function (a), since the formant is shifted to a high frequency domain, a thin voice is generated. The control function (b) generates a somewhat thin voice. If the control function (d) is used, since the formant frequency shifts to a low frequency domain, a deep voice is generated. The control function (c) generates a deeper voice.

Figure 13:
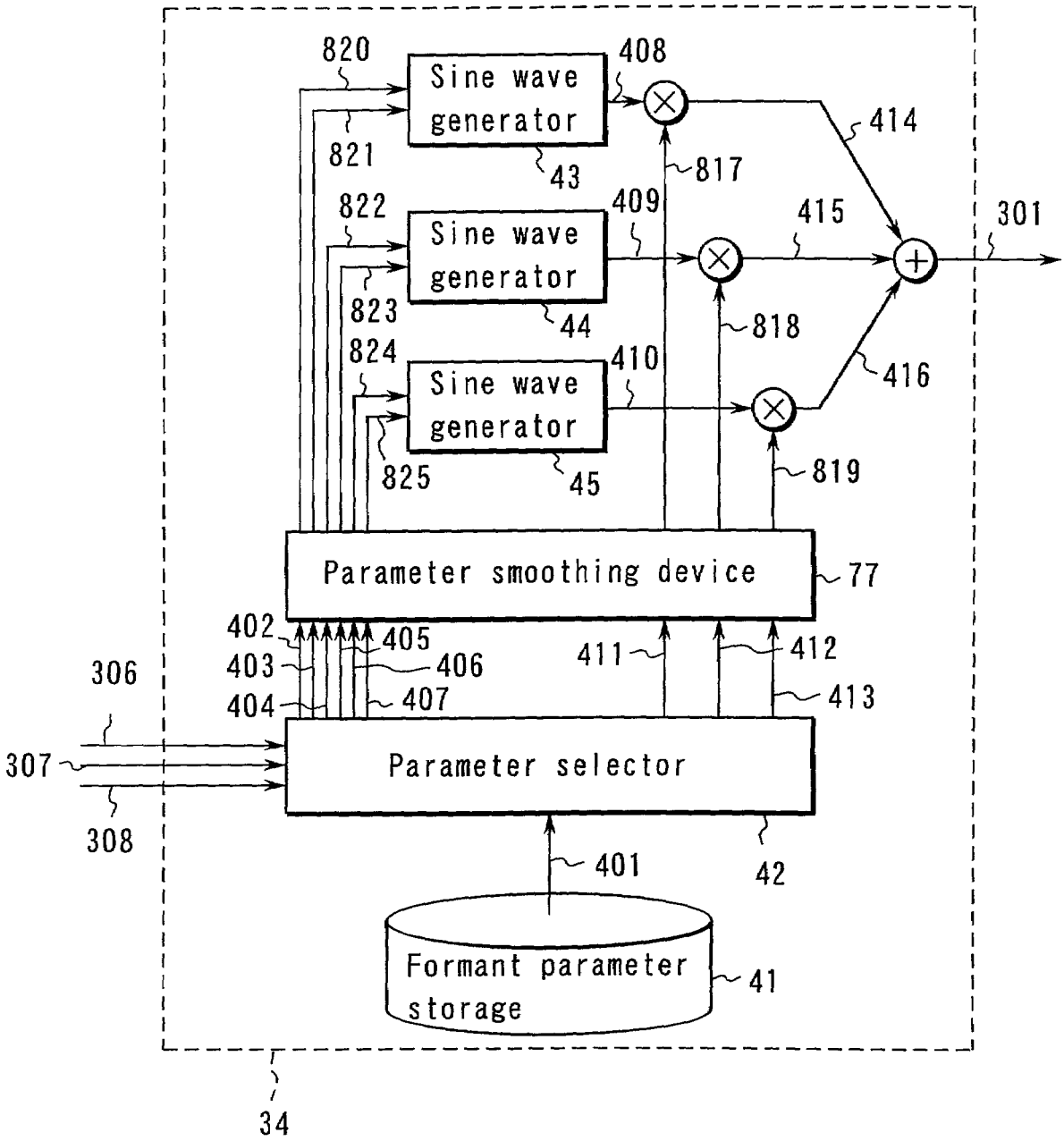
FIG. 13 shows a block diagram of a pitch waveform generator of the fourth embodiment of the present invention.

The pitch waveform generator 34 of the fourth embodiment of the present invention will be described referring to FIG. 13. In the fourth embodiment, like reference numerals are used to designate like structural elements corresponding to those in the first embodiment. Only the portions that differ will be described. In the present embodiment, the parameter smoothing device 77 is added to smooth the parameters so that the time based change of each formant parameters is smoothed.

The parameter smoothing device 77 outputs formant frequency 820, formant phase 821, windowing function 817, formant frequency 822, formant phase 823, windowing function 818, formant frequency 824, formant phase 825 and windowing function 819 by smoothing the formant frequency 402, formant phase 403, windowing function 411, formant frequency 404, formant phase 405, windowing function 412, formant frequency 406, formant phase 407 and windowing function 413, respectively. All parameters may be smoothed, or merely partly smoothed.

Figure 14:
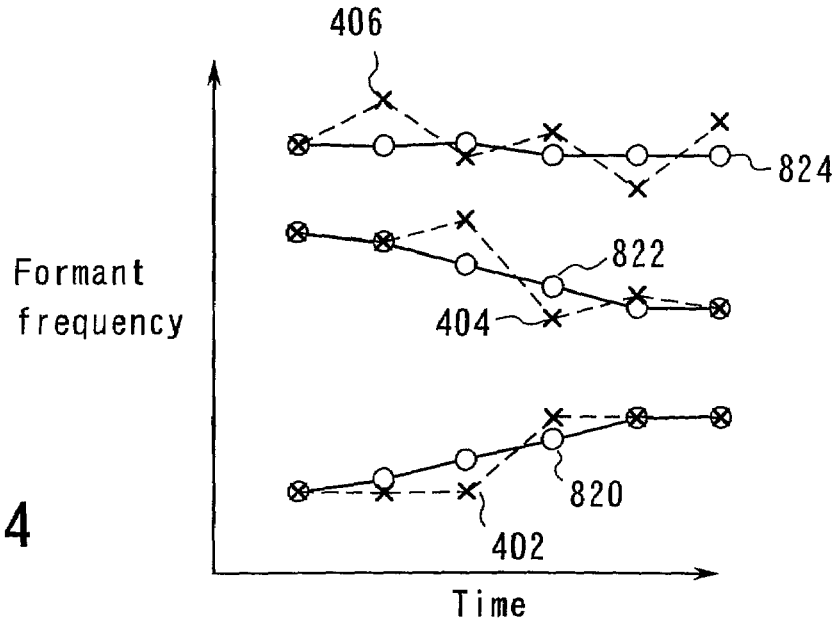
FIG. 14 shows a diagram for explaining smoothing of the formant frequency.

FIG. 14 shows an example of smoothing of formant. X represents the formant frequencies 402, 404 and 406 before smoothing. The smoothed formant frequencies 820, 822 and 824 indicated by ○ are generated by performing smoothing so that a change between corresponding formant frequencies of the current frame and the preceding or following frame are smoothed.

Figure 15A:
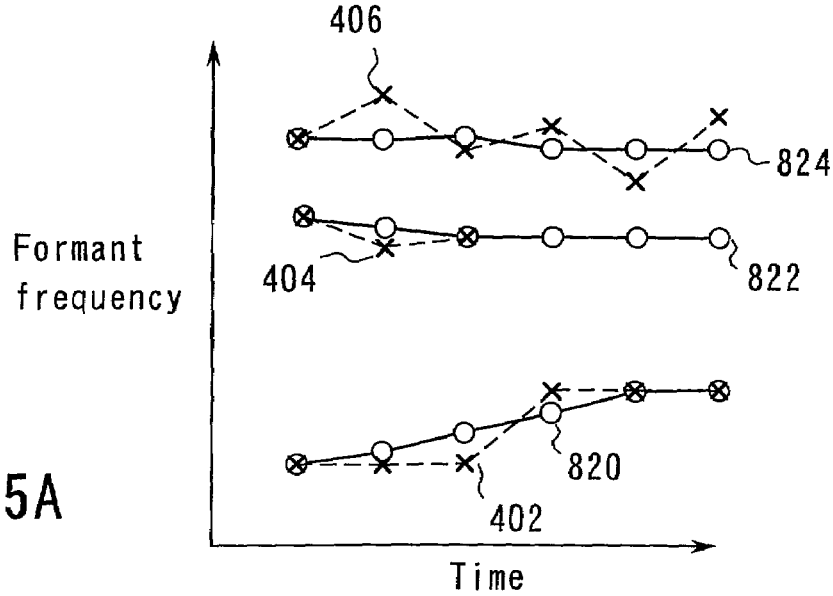
FIGS. 15A and 15B show another diagram for explaining smoothing of the formant frequency.
Figure 15B:
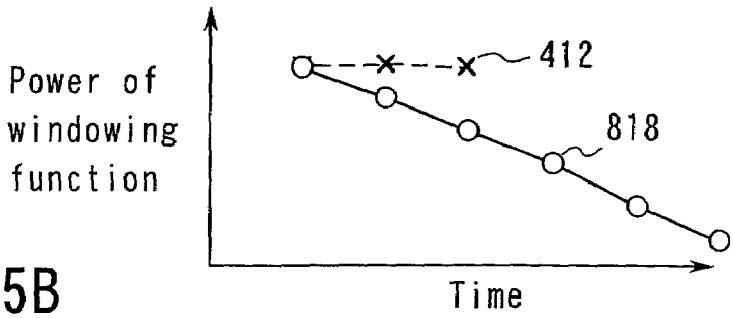

When the formants between synthesis units do not correspond, the formant corresponding to the formant frequency 404 becomes extinct, as shown by X in FIG. 15A. In this case, since large discontinuity produces to the spectrum and the speech quality deteriorates, the formant frequency 822 is generated by adding formants as shown by ○. At this time, the power of the windowing function 818 corresponding to the formant frequency 822 is attenuated as shown in FIG. 15B, to prevent the formant power from discontinuity.

Figure 16A:
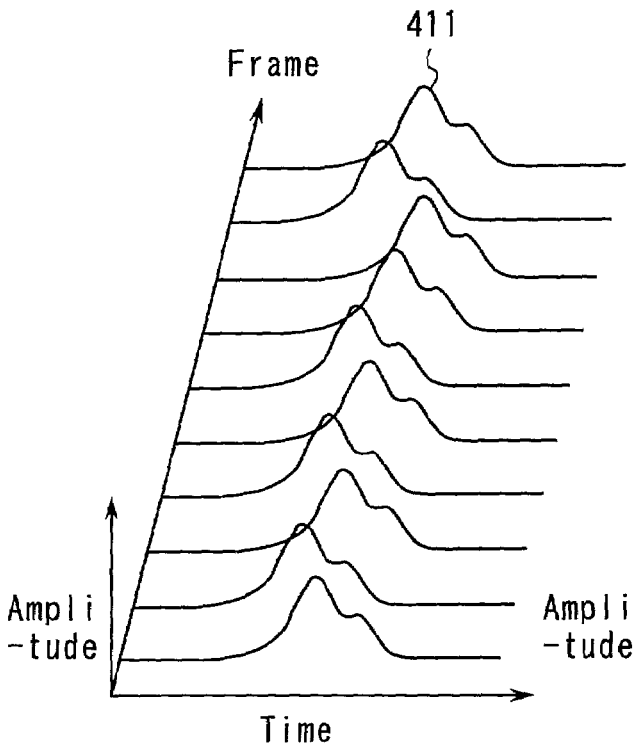
FIGS. 16A and 16B show smoothing states of windowing functions.
Figure 16B:
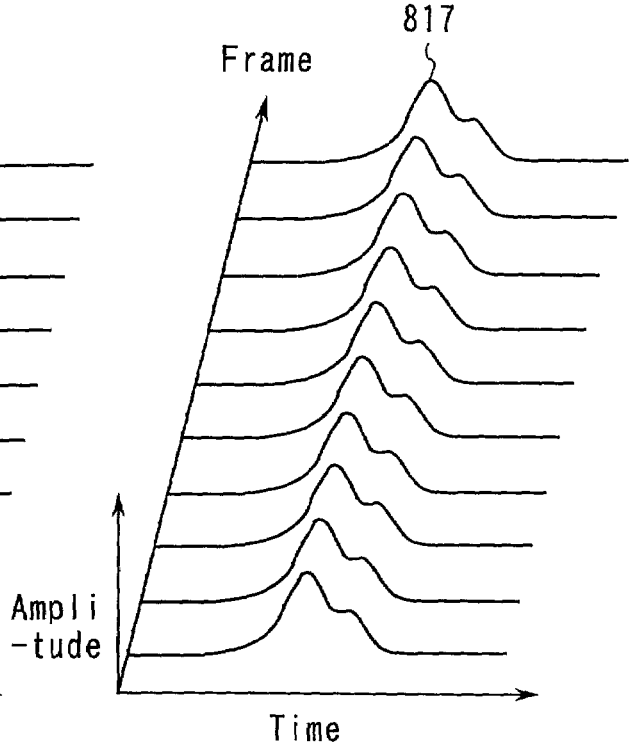

FIGS. 16A and 16B show examples of windowing function position smoothing. Smoothing the windowing function positions so that the peak position of the windowing function 411 varies between frames smoothly generates the windowing function 817. Further, the shape and power of the windowing function may also be smoothed.

The above embodiment is explained for 3 formants. The number of formants is not limited to 3, and may be changed every frame.

The sine wave generator of the embodiments of the present invention outputs a sine wave. However, a waveform having a near-line power spectrum may be used instead of a complete sine wave. In case that computation precision of the sine wave generator is degraded and the sine wave generator comprises a table in order to reduce computation cost, for example, the complete sine wave is not obtained because of error.

Further, the spectrum of formant waveform may not always indicate the peak of the spectrum of speech signal, and the spectrum of the pitch waveform, which is the sum of plural formant waveforms, expresses a spectrum of speech.

The above embodiment of the present invention provides a synthesizer for text-to-speech synthesis, but another embodiment of the present invention provides a decoder for speed coding. In other words, the encoder obtains, from the speech signal, formant parameters such as formant frequency, formant phase, windowing function, etc. and pitch period, etc. by analysis, and encodes them and transmits or store codes. The decoder decodes the formant parameters and pitch periods, and reconstructs the speech signal similarly to the above synthesizer.

Figure 17C:
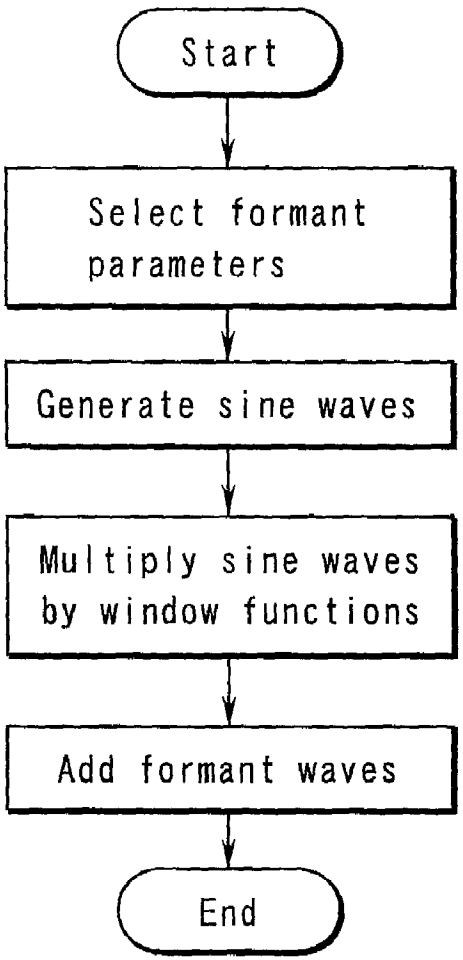
FIGS. 17A, 17B and 17C show flow charts for explaining processes of the speech synthesizer of the present invention.

The above speech synthesis can be executed by a program control according to a program stored in a computer readable recording medium. The program control will be described referring to FIG. 17A or more 17C. FIG. 17A show a flowchart of the speech synthesis process, FIG. 17B shows a flowchart of the voiced speech generation process of the speech synthesis process, and FIG. 17C shows a flowchart of the pitch waveform generation process of the voiced speech generation process of FIG. 17B.

In the speech synthesis process in FIG. 17A, the pitch pattern 306, phoneme duration 307 and phoneme symbol string 308 are input (S11). The voiced speech signal 303 is generated based on the pitch pattern 306, phoneme duration 307 and phoneme symbol string 308 (S12). The unvoiced speech signal 304 is generated referring to the phoneme duration 307 and phoneme symbol string 308 (S13). The voiced speech signal and unvoiced speech signal are added to generate the synthesized speech signal 305 (S14).

Figure 17B:
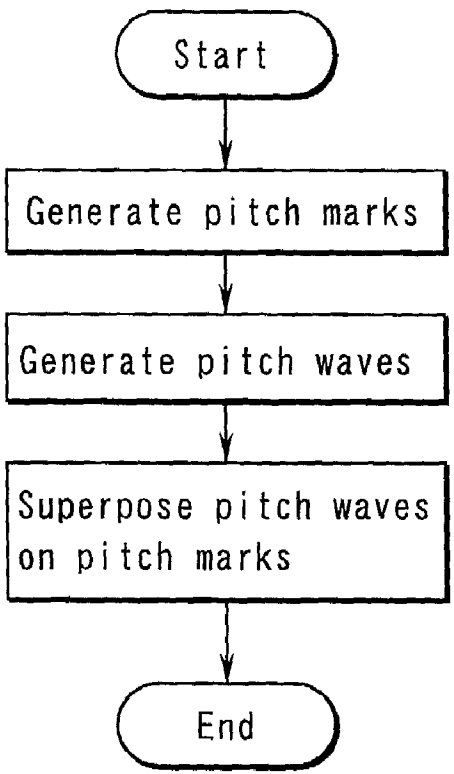
Figure 17A:
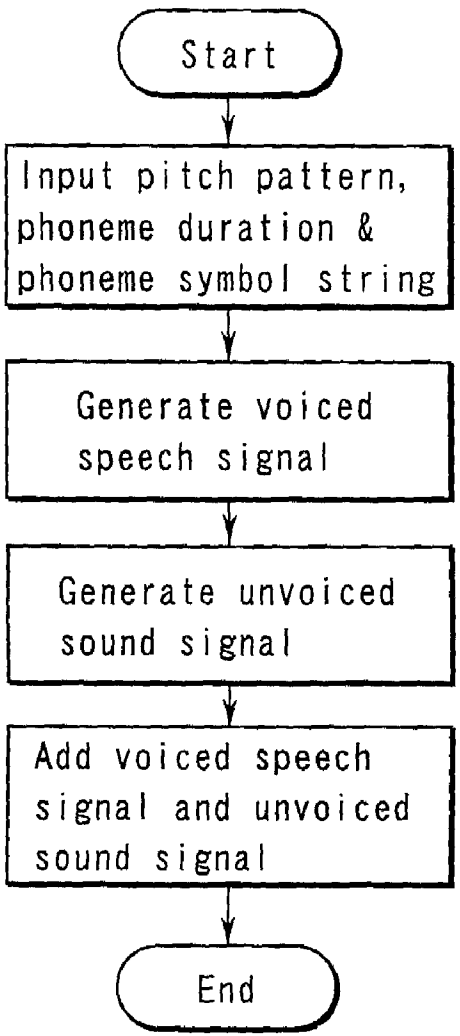

In the voiced speech generation process in FIG. 17B, the pitch mark 302 is generated referring to the pitch pattern 306 and phoneme duration 307 (S21). The pitch waveforms 301 are generated corresponding to the pitch marks 302, referring to the pitch pattern 306, phoneme duration 307 and phoneme symbol string 308 (S22). The pitch waveforms 301 are superposed in the positions indicated by the pitch marks 302 to generate a voiced speech (S23).

In the pitch waveform generation process in FIG. 17C, the formant parameters 401 for 1 frame corresponding to the pitch mark 302 is selected from the formant parameter storage 41 referring to the pitch pattern 306, phoneme duration 307 and phoneme symbol string 308 (S31). Plural sine waves are generated according to the formant frequencies and formant phases corresponding to the formant numbers of the selected formant parameters 401 (S32). The formant waveforms 414, 415 and 416 are generated by multiplying the plural sine waves by the windowing functions (S33). The formant waveforms are added to generate a pitch waveform (S34).

As described above, according to the present invention, since the formant frequency and formant shape are independently controlled for every formant, it is possible to express the spectrum change of speech due to the pitch period variation and voice variety change between the formants, and realize highly flexibility speech synthesis. Because the shape of the windowing functions can express the detailed structure of the formant spectrum, high quality synthesized speech having a natural voice feeling can be generated.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A speech synthesis method comprising:

storing a plurality of formant parameter groups each including a number of formant parameters in a storage in units of a synthesis unit, the formant parameters representing a formant frequency, a formant phase and a windowing function;

selecting predetermined formant parameters from the formant parameters stored in the storage according to a phoneme symbol string;

generating a plurality of sine waves based on formant frequencies and formant phases corresponding to the formant parameters selected;

multiplying the sine waves by the windowing functions corresponding to the selected formant parameters, respectively, to generate a plurality of formant waveforms each having a characteristic of one formant;

adding the formant waveforms to generate a pitch waveform having characteristics of a plurality of formants; and superposing pitch waveforms each corresponding to the pitch waveform according to a pitch period to generate a speech signal.

2. A speech synthesis method as defined in claim 1, wherein the formant waveform y (t) is expressed by the following equation:

$$y(t)=w(t)*\sin(\omega t+\phi)$$

where the formant frequency is ω, the formant phase φ and the windowing functions w(t).

3. A speech synthesis method as defined in claim 1, which includes storing weighting factors in the storage and adding basis functions weighted by the weighting factors to generate the windowing functions.

4. A speech synthesis method as defined in claim 1, which includes changing at least one of power of at least one of the formant waveforms, shape of at least one of the windowing functions, position of at least one of the windowing functions and at least one of the formant frequencies according to the pitch period.

5. A speech synthesis method as defined in claim 4, wherein at least one of power of at least one of the formant waveforms, shape of at least one of the windowing functions, position of at least one of the windowing functions and at least one of the formant frequencies is changed every phoneme, every frame or every formant number.

6. A speech synthesis method as defined in claim 1, which includes changing at least one of power of at least one of the formant waveforms, shape of at least one of the windowing functions, position of at least one of the windowing functions and at least one of the formant frequencies according to a kind of at least preceding phoneme or following phoneme.

7. A speech synthesis method as defined in claim 1, which includes changing at least one of power of at least one of the formant waveforms, shape of at least one of the windowing functions, position of at least one of the windowing functions and at least one of the formant frequencies according to information of given voice variety.

8. A speech synthesis method as defined in claim 1, which includes changing at least one of power of at least one of the formant waveforms, at least one of the formant frequencies, shape of at least one of the windowing functions, phase of at least one of the sine waves and position of at least one of the windowing functions according to at least one of power of at least one of the formant waveforms, at least one of the formant frequencies, shape of at least one of the windowing functions, phase of at least one of the sine waves and position of at least one of the windowing functions of a corresponding formant of at least a preceding pitch waveform or a following pitch waveform.

9. A speech synthesis method as defined in claim 1, which includes changing at least one of power of at least one of the formant waveforms, at least one of the formant frequencies, shape of at least one of the windowing functions, phase of at least one of the sine waves and position of at least one of the windowing functions according to presence of a corresponding formant of at least a preceding pitch waveform or a following pitch waveform.

10. A speech synthesis method as defined in claim 1, which includes smoothing selectively the formant frequencies, formant phases, and windowing functions.

11. A speech synthesizer supplied with a pitch pattern, phoneme duration and phoneme symbol string, comprising:

a pitch mark generator configured to generate pitch marks referring to the pitch pattern and phoneme duration;

a pitch waveform generator configured to generate pitch waveforms corresponding to the pitch marks, referring to the phoneme symbol string;

a waveform superposition device configured to superpose the pitch waveforms on the pitch marks according to a pitch period to generate a voiced speech signal;

a unvoiced speech generator configured to generate an unvoiced speech;

an adder configured to add the voiced speech and the unvoiced speech to generate a synthesized speech, the pitch waveform generator including:

a storage configured to store a plurality of formant parameter groups each including a plurality of formant parameters in units of a synthesis unit, the formant parameters representing a formant frequency, a formant phase and a windowing function, a parameter selector configured to select the formant parameters for one frame corresponding to the pitch marks from the storage referring to the phoneme symbol string, a plurality of sine wave generators configured to generate a plurality of sine waves according to formant frequencies and formant phases corresponding to the selected formant parameters, a multiplier configured to multiply the sine waves by the windowing functions of the selected formant parameters to generate a plurality of formant waveforms each having a characteristic of one formant, an adder configured to add the formant waveforms to generate a pitch waveform having characteristics of a plurality of formants.

12. A speech synthesizer as defined in claim 11, wherein the windowing functions are stored in the storage.

13. A speech synthesizer as defined in claim 11, wherein the storage stores weighting factors of the windowing functions, and which comprises a windowing function generator configured to generate the windowing functions by adding basis functions weighted by the weighting factors.

14. A speech synthesizer as defined in claim 11, which includes a parameter transformer configured to transform the selected formant parameters according to the pitch period.

15. A speech synthesizer as defined in claim 14, wherein the parameter transformer transforms the selected format parameters every phoneme, every frame or every formant number.

16. A speech synthesizer as defined in claim 11, which includes a parameter transformer configured to transform the selected formant parameters according to information of a preceding phoneme or a following phoneme.

17. A speech synthesizer as defined in claim 11, which includes a parameter transformer configured to transform the selected formant parameters according to given voice variety.

18. A speech synthesizer as defined in claim 11, which includes a parameter smoothing device configured to smooth the selected formant parameters that vary in time.

19. A speech synthesis program recorded on a computer readable medium, the program comprising:

means for instructing a computer to store a number of formant parameters in a storage, the formant parameters representing a formant frequency, a formant phase and a windowing function;

means for instructing the computer to select predetermined formant parameters from the formant parameters stored in the storage according to a phoneme symbol string;

means for instructing the computer to generate a plurality of sine waves based on formant frequencies and formant phases corresponding to the formant parameters selected;

means for instructing the computer to multiply the sine waves by the windowing functions corresponding to the selected formant parameters, respectively, to generate a plurality of formant waveforms each having a characteristic of one formant;

means for instructing the computer to add the formant waveforms to generate a pitch waveform having characteristics of a plurality of formants; and means for instructing the computer to superpose pitch waveforms each corresponding to the pitch waveform according to a pitch period to generate a speech signal.

20. A speech synthesis program as defined in claim 19, which includes means for instructing the computer to add basis functions weighted by the weighting factors to generate the windowing functions.

* * * * *